US005303625A

United States Patent [19]

Hai-Shen

[11] Patent Number: 5,303,625

[45] Date of Patent: Apr. 19, 1994

[54] LAYER PIERCING PAPER PUNCH

[76] Inventor: Nui Hai-Shen, 16-2, Lane 91, Feng Jen Road, Wan Nai Tsun, Jen Wu, Kao Hsiung, Taiwan

[21] Appl. No.: 922,228

[22] Filed: Jul. 31, 1992

[51] Int. Cl.[5] ..... B26F 1/02

[52] U.S. Cl. ..... 83/447; 83/449; 83/468.93; 83/687; 83/691

[58] Field of Search ..... 83/468.93, 468.94, 456, 83/685, 686, 687, 690, 691, 454, 453, 447, 449; 30/358

[56] References Cited

U.S. PATENT DOCUMENTS

| | | | |
|---|---|---|---|
| 430,168 | 7/1890 | Brown | 83/468.93 |
| 1,389,263 | 8/1921 | Morris | 83/456 |
| 1,490,172 | 4/1924 | Hurrel | 83/167 |
| 2,415,538 | 2/1947 | Segal | 83/468.93 |

*Primary Examiner*—Frank T. Yost
*Assistant Examiner*—Allan M. Schrock
*Attorney, Agent, or Firm*—Burns, Doane, Swecker & Mathis

[57] ABSTRACT

A layer piercing paper punch is disclosed, in which a plurality of cutting hole plates is provided on a base between the location of a cutting hole and an upper cutter bar for perforation. Each of the cutting hole plates has a sharp-pointed portion on the front end and a cutting hole near the middle part. The cutting hole plates lying parallel to the surface of the base and in an overlapping position are always maintained by a position-fixing member with cutting holes in alignment with the upper cutter bar and the lower cutting hole on the base thereby enabling the cutting hole plates to perform up and down movement without any movement on the sides during the perforation of a paper file.

6 Claims, 5 Drawing Sheets

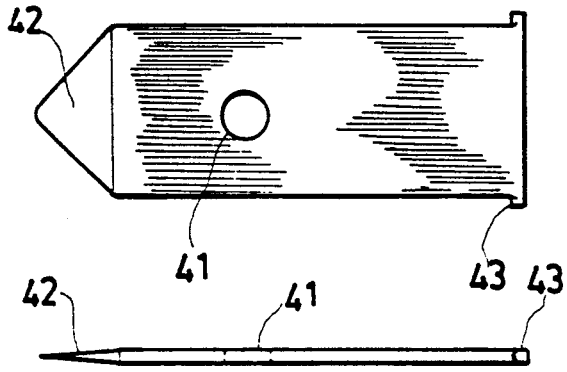
FIG. 2a
FIG. 2b
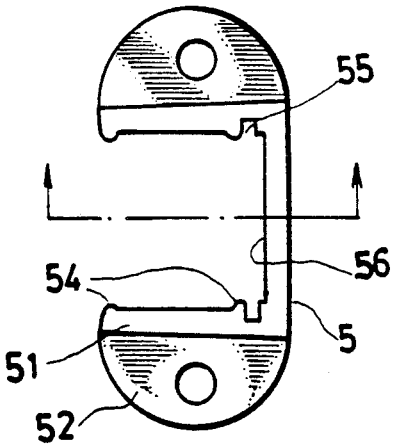
FIG. 3

LAYER PIERCING PAPER PUNCH

FIELD OF THE INVENTION

The present invention relates to a paper punch and more particularly, to a layer piercing paper punch provided on its base between the face of the punching hole stand and the cutter bar on the above with a plurality of parallel superimposed plates each having a corresponding punching hole as in the cutter bar on the above and the punching hole plates being held in fixed position and capable of moving in an up and down direction only and further the punching hole plates each formed at the front end with a sharp pointed portion to be easily inserted in the paper pile. With the paper punch of the invention constructed as the above it is possible to perform with a saving of labor the perforation of a thick layered paper pile by the punching hole plates inserting in spaced apart manner in the thick paper pile to be perforated and separating the thick paper pile into several thinner paper piles of substantially similar thickness thereby permitting the cutter bar to pierce the thinner paper piles in layer with a least force and at one action of punching operation.

Many types of paper punch are known and of the commonly used ones, as shown in FIGS. 9 through 11, three types may be obtained. Among these, the paper punch shown in FIG. 9 is the most frequently used, in which, a pile of paper is inserted between its base 1 having punching holes (not shown) and the cutter bar 2 on the above and perforation is next performed after the front edge of the pile of paper has touched the cutter frame 3. However, this type of paper punch is mostly designed to perforate a pile of paper of about 2 mm in thickness only and the punching thickness is thus very much limited. When it is to punch a large amount of office paper, punching will be very much inconvenient and troublesome. Although there are large-sized paper punches of the type capable of penetrating piles of paper of about 5 mm in thickness, the operation of depressing is however much more laborious. For a male operator, it would already be a difficult task with this large sized paper punch. When there are in proportion more female office staff to use the paper punch, it can be imagined how arduous it would have been, and there is therefore a need for improvement.

As for large-sized paper punch known for use in punching thick layer pile of paper (about 8 mm to 1 cm), there are types as shown in FIGS. 10 and 11. Among these, the paper punch, as shown in FIG. 10, has features mainly in that the base 1 is mounted with a cutter bar 2 capable of forwarding and backwarding by rotating operation. In punching, it is to rotate the operating handle 21 with fingers permitting the cutter bar 2 to rotate and move down by the thread construction 22 and to perform perforation by cutting and pressing the pile of paper below. Scraps of paper are discharged out from an orifice on the upper part of the cutter bar 2. There are drawbacks with this type of punching machines because in use the machine is very slow in action and is time-consuming and also because cut scraps of paper are fully collected inside the cutter bar 2 resulting in a considerable resistance and also making the operation laborious.

In another instance, FIG. 11 shows the known large-sized paper punching machine with a solid cutter bar. The punching machine, in construction, has a base 1 provided with a punching hole 11, a paper scraps collecting part 12 and a paper edge position-adjusting device 13, the solid cutter bar 2 mounted on a cutter frame 3 to be vertically movable relative to the punching hole 11 underneath, and a cutter frame 3 mounted on the base 1 and having a pivotal operating handle 31 to be able to couple and control the cutter bar 2 into a vertical movement. As the mechanism for converting a pivoting motion into a linear motion is a known technology and is known in the industry, it will not be dealt with in detail here. This machine is capable of punching a pile of paper of about 1 cm in thickness, however, in use there will still be a feeling of laboriousness with application of a full strength when speaking from the male operator only much less speaking from a female user. To those with some mechanical knowledge it can be understood that to force perforate a pile of paper 1 cm thick could be very arduous. For this reason, the outer diameter of the cutter bar can only be constructed in about 4.5 mm, which is thinner than the cutter bar 6.5 mm thick of the aforesaid known punching machines and which would otherwise be very difficult to pierce a thick paper pile. Therefore, when for binding the punched paper piles only fine binding ropes can be used and, not with the frequently used thick binding equipment, this also a drawback of the type of paper punch.

The present invention aims at solving the aforesaid shortcomings in the known paper punching machines and to provide a layer piercing paper punch for labor-saving use, in which at least one or more plates having punching holes are mainly arranged between a base and a cutter bar on the above to divide a thick paper pile inserted therebetween into several thin paper piles so as to enable cutter bar to easily pierce the thin paper piles in layer under one depressing operation and further because at the bottom each of the paper piles is able to bear shearing action at the punching hole edge of the plate below it can further facilitate easy piercing of the paper pile. The number of the punching hole plates to be provided with may vary with size of a paper punch, there may be mounted with one or two plates or with an appropriate number of plates. With the paper punch of the invention having the construction and the kind of technical concept there can be completely done away with any confusion caused by the laboriousness and inconvenience in the perforation of thick layer of the paper pile with the aforesaid known punching machines.

BRIEF DESCRIPTION OF THE DRAWINGS

The present invention will be described in detail with reference to the drawings, in which:

FIGS. 2*a* and 2*b* are top and side views respectively of the punching hole plates of the punch;

FIG. 3 is a top view of the position-adjusting device of the punch;

DETAILED DESCRIPTION OF THE PREFERRED EMBODIMENTS

Figure 1:
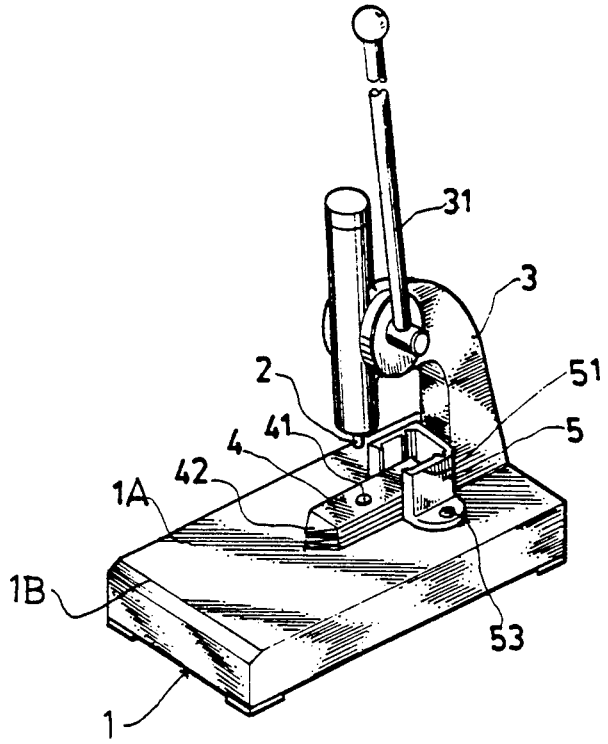
FIG. 1 is a perspective view of a layer piercing paper punch of the invention.

Referring to FIGS. 1 through 7, there is shown a first embodiment of the layer piercing paper punch of the present invention. First, the paper punch, as shown in FIGS. 1 to 5 comprises a base 1 defining a support surface 1A having a lower cutting hole 11. The base includes a collecting part 12 for scrap of paper; a cutter frame 3 mounted on the base 1 and capable of moving vertically up and down in relation to the cutting hole 11 by pivoting an operating handle 31 to work a cutter bar 2; one or more cutting hole plates 4 each provided with secondary cutting hole 41 corresponding to the cutting hole 11 of the base and having a slightly larger diameter than the cutter bar 2 and each having a sharp-pointed portion 42 at the front end and the cutting hole plates being arranged in a stack which is held in position and vertically movable only; and a positioning member 5 mounted on the base 1 and slightly behind the cutting holes 41 of the plates for holding the overlapped cutting hole plates 4 to be vertically movable only and not to deviate on all sides.

Figure 5:
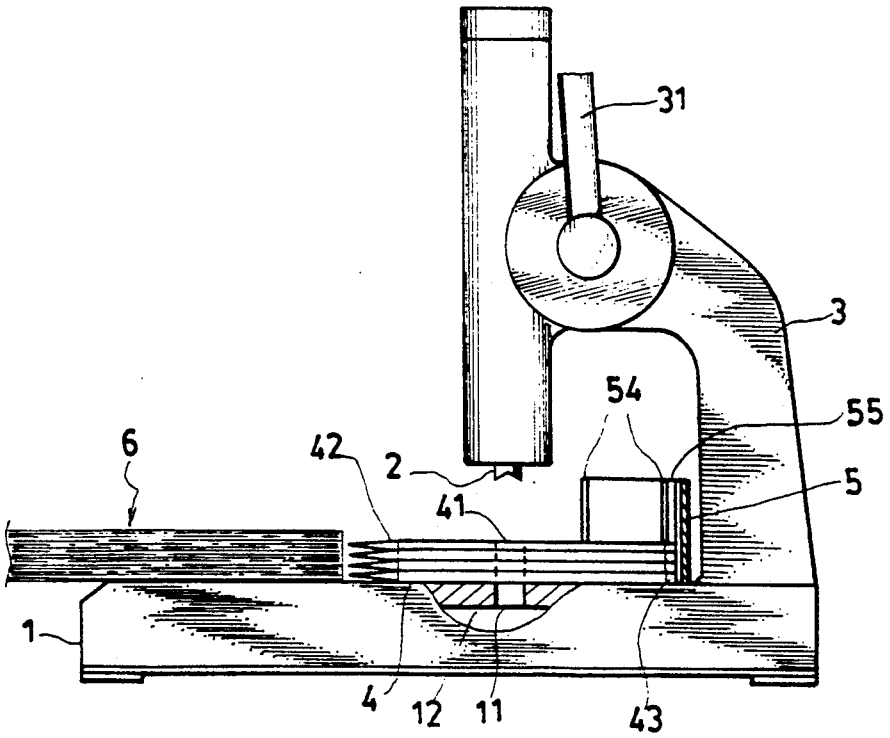
FIG. 5 is a sectional side view of the essential parts of the punch before the inserting in of a pile of paper.
Figure 4:
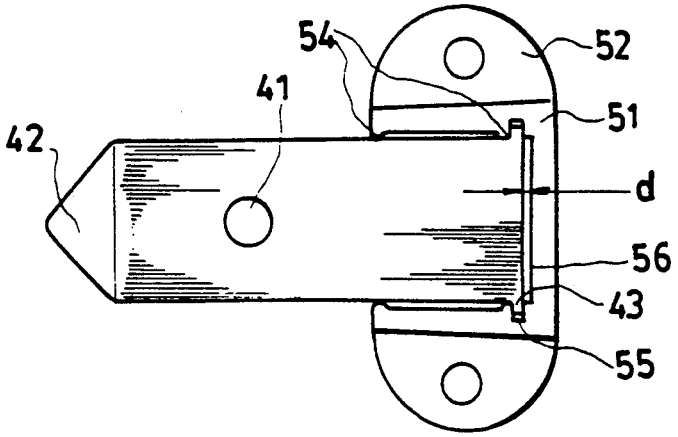
FIG. 4 is a top view of the punching hole plate being fitted in the position-adjusting device.
Figure 6:
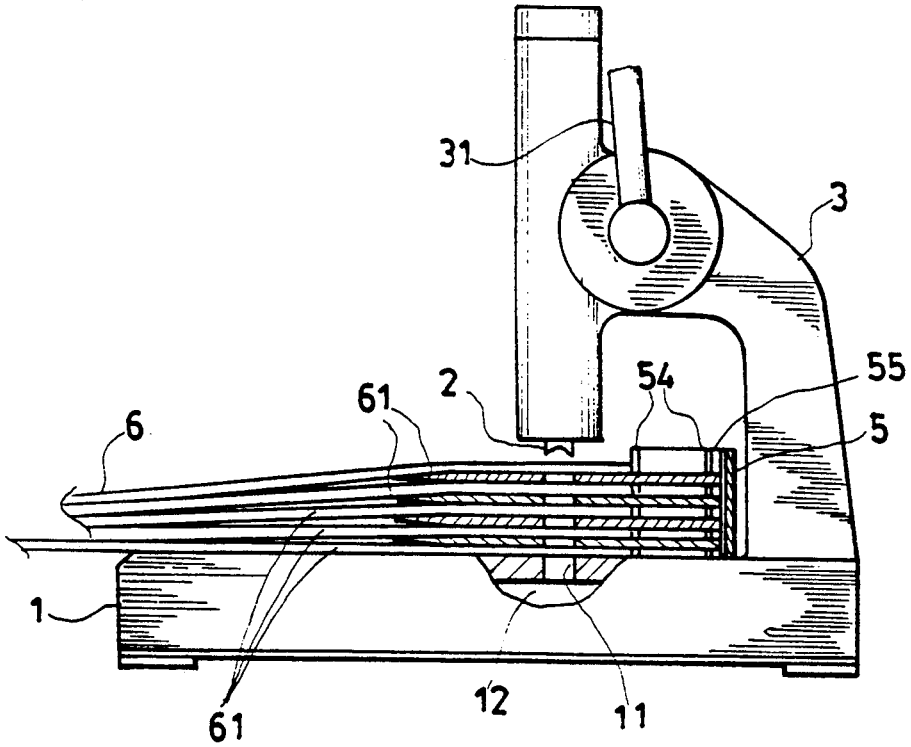
FIG. 6 is a sectional side view of the essential parts of the punch after the punching hole plates have been fitted into the pile of paper.
Figure 7:
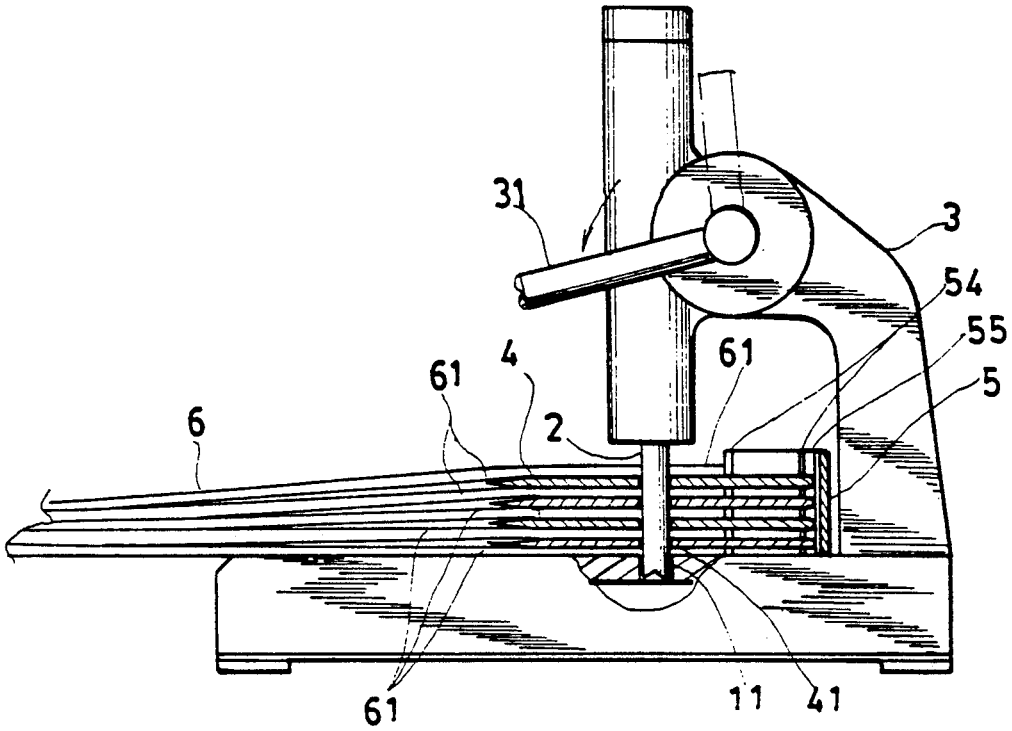
FIG. 7 is a sectional side view of the essential parts of the punch having the cutter bar piercing the pile of paper.

Detail of the cutting hole plates 4 is as shown in FIGS. 2*a* and 2*b* and in the present embodiment, each of the cutting hole plates 4 constitutes a rectangular body, preferably of a thickness of about 2 to 3 mm, the front end of which forms a wedge-shaped sharp-pointed portion 42 becoming thinner gradually to facilitate its insertion in a thick paper pile 6 to be perforated (as shown in FIGS. 5 and 6). The wedge-shaped portions 42 are spaced from a peripheral edge 1B of the support surface 1A to enable a pile of sheets 6 to be positioned in facing relationship to the wedge-shaped portions 42 (see FIG. 5). The cutting hole plate is next defined on about the first half part thereof with the cutting hole 41 having a slightly larger diameter than the cutter bar 2 (a known cutting hole plate with a diameter of 6.5 mm may be used) on the above, whereas the rear half part of each of the cutting hole plates 4 is provided on each side with a projection in the form of a cylindrical pivot 43 for use in positioning. The diameter of the cutting hole 41 is preferably larger than that of the cutter bar 2 by 0.5 to 1 mm so as to compensate for any deviation of the cutting hole 41 caused by slight deviation or slanting of the cutting hole plates 4.

The positioning member 5 mentioned above is formed with a U-shaped portion 51 forming a vertical channel capable of encompassing the rear ends of the cutting hole plates 4 and which by means of hole-containing lug plates 52 on the two sides is capable of being firmly secured onto the base 1 by screws 53. The U-shaped portion 51 of this positioning member 5 is provided on front and rear parts of the two inner sides each with a pair of vertical projections 54 for use in positioning. The rear part of the U-shaped portion 51 is further provided by vertical indenting on both sides with a pivot-positioning guide slot 55 (FIG. 4) for rotatable inserting therein of the pivots 43 of the cutting hole plates 4. Next, there is formed on the inner side of the rear part of the U-shaped portion 51 at a slightly backward location a depression 56 which maintains between itself and the rear edge of the guide slot 55 a small distance d in order to reduce frictional resistance between the rear end of the cutting hole plate 4 and the inner side of the rear part of the U-shaped portion 51.

The cutting hole plates 4 are inserted in the positioning guide slots 55 (see FIGS. 1, 4 and 6) of the positioning member 5 by the pivoting parts 43, and are locked in by the two sides with a very small clearance between the positioning projections 54 on the two sides of the U-shaped portion 51 and kept in positioning thereby permitting each of the superimposed cutting hole plates 4 to move vertically and not to move or deviate on all sides. Besides, the arrangement also allows the cutting hole 41 of each of the cutting hole plates 4 to be able to constantly align itself with the cutter bar 2 on the above and the cutting hole 11 of the base 1 beneath with an extremely small amount of deviation from all sides thereby permitting the cutter bar 2 to pass through the cutting holes 11 and 41 safely and perform perforation smoothly.

During use with a layer piercing paper punch of the present invention as constructed above, first, a thick pile of paper 6 is held with a hand, as shown in FIG. 5, to place the front end face of the paper pile 6 in contact with the pointed ends of the sharp-pointed portions 42 of the superimposed cutting hole plates 4. Next, the paper pile 6 is pushed to move forward so that the sharp-pointed parts 42 of the cutting hole plates 4 get inserted in the front end parts of the paper pile 6 (see FIG. 6), thereby separating the originally thick paper pile initially into several layers of thinner paper piles or groups 61. Following this action, the cutting hole plates 4 are gradually raised up by the wedge faces of the sharp-pointed portions 42 by the layers of the paper piles 61 till the front end edge of the paper pile 6 rests against the front end face of the positioning member 5. Meanwhile, during the time when the paper pile 6 is advancing between the cutting hole plates 4, it is nevertheless preferable to move the paper pile 6 lightly around so as to enable the cutting hole plates 4 to be moved upwardly at an even more smooth and steady manner. In reality, it has been proved that by the forward movement of the paper pile 6 only is sufficient to enable the cutting hole plates 4 to be moved up smoothly and steadily. After the above process, finally, it is possible to push down the operating handle 31 and perform process of perforating the paper piles 61 by layers. As the cutter bar 2 moves down and performs perforation it is accomplished by the pointed end of the cutter bar 2 pressing against the paper piles 61 below, while simultaneously permitting the cutter bar 2 to pierce through the paper piles 61 in cooperation with the cutting action by the edges of the cutting holes 41 of the cutting hole plates 4 in relation to the paper piles 61. After the upper first layer of the paper piles 61 has been perforated by the cutter bar 2, the cutter bar 2, by the lower end thereof and the cut circular scraps of paper pressing against the next layer of paper piles 61 and in cooperation with the cutting action by the edges of the cutting hole 41 of the cutting hole plates 4 below the layer of paper piles 61, perforates again this layer of paper pile. In this way, following the sequence it is possible to perforate by layer all of the paper piles-61 below under one single push action, in which the paper pile 61 that has been perforated each time is separated into much thinner layers of paper pile 61 and as a result, the strength needed each time for perforating each of the paper piles 61 is considerably small and the strength needed in each perforation is more or less the same. Therefore, with a very little strength and under one single push perforating action the paper punch of the invention perforates a pile of a thick paper pile P. The punch is very much labor-saving and convenient and can still be maintained in use with a thick cutter bar 2 of 6.5 mm D. By the paper punch of the present invention, it has done away the laborious drawback in the perforation of thick paper piles by the conventional punches and has proved to be a useful utility in industry.

In the above embodiment, a paper punch with four pieces of cutting hole plates 4 has been taken as an example. Apparently, it is also possible if a small-size punch applying the characteristics of the present invention is fitted therein with, one or two pieces of cutting hole plates 4. Likewise, it will also be possible when applied with a large-size paper punch the number of cutting hole plates 4 is increased to more than four pieces. However, if with an excess of the pieces there will be cause for uneven upward movement of the cutting hole plates and an increase in the forward inclination and have likelihood of the cutter bar touching the holes on the upper cutting hole plates. In this connection, it may be most appropriate to search for a suitable number of plates on consideration of the applicability.

It is to be understood that the forms of the invention herein shown and described are to be taken as merely preferred examples of the same, and that the invention may be otherwise modified within the spirit and scope of the invention. For instance, the number of the cutting hole plates can be anything and is not to be limited and also the construction for maintaining the cutting hole plates 4 in position represents merely a positioning member.

Figure 8:
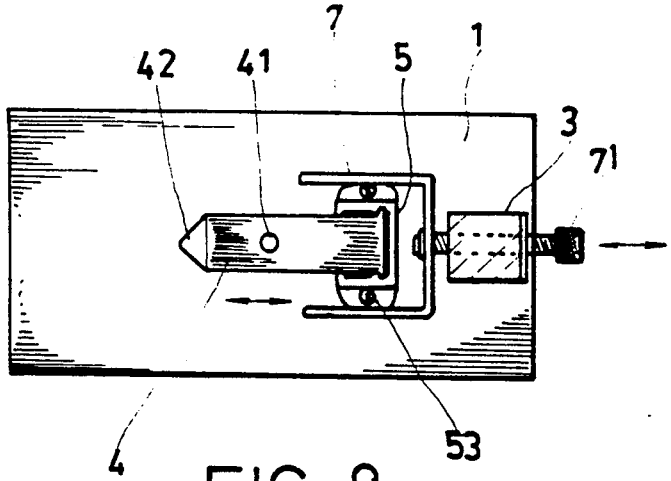
FIG. 8 is a top view of the essential parts of one application embodiment of the paper punch.
Figure 9:
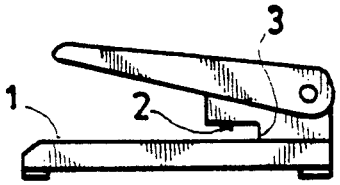
FIG. 9 (PRIOR ART)
FIGS. 9 to 11 are side views showing respectively three kinds of the known paper punches.
Figure 10:
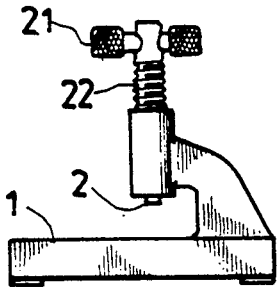
FIG. 10 (PRIOR ART)
Figure 11:
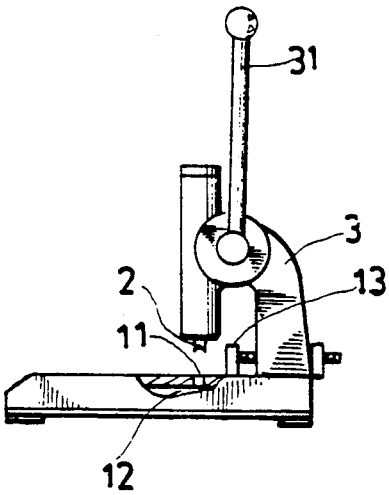
FIG. 11 (PRIOR ART)

Next, FIG. 8 illustrates an applicable example of the present invention having position fixing means for paper pile front end. This example has utilized a conventional position adjusting device to fix position of the front end of the paper pile. Since it is not intended to be an object or scope of the claims of the invention, this will be briefly described as follows. In the drawing, there is shown mounting on the two sides of the positioning member 5 in the paper punch of the invention an adjusting device 7 for fixing position of the front end of the paper operable for movement along the back and forth direction by a knob and screw 71. Since this adjusting device for fixing position can easily be a known structure, it will not be described in detail here.

I claim:

1. A paper punch comprising:

a base having a horizontal support surface and a lower hole formed therein, a punching machine mounted on said base and including a cutter bar vertically movable to enter said lower hole;

a stack of plates normally seated on one another and resting on said support surface beneath said cutter bar, each plate having a secondary hole vertically aligned with said lower hole so that said cuter bar can pass through said secondary and lower holes, said plates including pointed front ends spaced from a peripheral edge of said support surface so that a pile of sheets can be positioned on said support surface in facing relationship to said stack of plates, said plates being freely vertically movable relative to one another and to said base in response to the pile of sheets being pushed against said front ends of said plates so that said plates divide the pile of sheets into vertically spaced groups of sheets to facilitate the passage of said cutter bar therethrough; and plate-positioning means for guiding said plates for vertical movement relative to said base with said secondary holes maintained in vertical alignment with said lower hole.

2. A paper punch according to claim 1, wherein said plate-positioning means comprises a member forming a vertical channel in which rear ends of said plates are disposed.

3. A paper punch according to claim 1, wherein said plate-positioning means comprises two upright side walls each having a vertical guide slot formed therein, a rear end portion of each plate being positioned between said side walls and having two projections extending into respective ones of said slots, said projections being freely vertically movable in said slots.

4. A paper punch according to claim 3, wherein each side wall includes two vertical projections spaced apart horizontally for engaging edges of said plates.

5. A paper punch according to claim 4, wherein said projections are cylindrical.

6. A paper punch according to claim 4, wherein said plate positioning means comprises a U-shaped plate having two parallel leg portions defining said side walls.

* * * * *